United States Patent [19]

Svoboda

[11] 4,312,518

[45] Jan. 26, 1982

[54] BRAKING BLADE AND MOUNTING THEREFOR

[75] Inventor: Josef Svoboda, Schwechat, Austria

[73] Assignee: TMC Corporation, Baar, Switzerland

[21] Appl. No.: 85,174

[22] Filed: Oct. 15, 1979

[30] Foreign Application Priority Data

Oct. 25, 1978 [AT] Austria ..... 7671/78

[51] Int. Cl.[3] ..... A63C 7/10

[52] U.S. Cl. ..... 280/605; 188/5; 403/345; 403/375

[58] Field of Search ..... 280/604, 605; 416/74; 115/24.1; 188/5, 8; 403/375, 345; 440/101, 102

[56] References Cited

U.S. PATENT DOCUMENTS

| | | | |
|---|---|---|---|
| 2,316,252 | 4/1943 | Karlsson | 280/605 |
| 3,256,031 | 6/1966 | Fillweber | 403/375 X |
| 3,709,534 | 1/1973 | Coe | 403/375 X |
| 3,930,659 | 1/1976 | Salomon | 280/605 |
| 4,083,576 | 4/1978 | Besser | 280/605 |
| 4,171,138 | 10/1979 | Riedel | 280/605 |

FOREIGN PATENT DOCUMENTS

| | | | |
|---|---|---|---|
| 339794 | 11/1977 | Austria . | |
| 616580 | 3/1961 | Canada | 280/605 |
| 98578 | 4/1923 | Fed. Rep. of Germany | 280/604 |
| 2525601 | 3/1977 | Fed. Rep. of Germany | 280/605 |
| 580434 | 10/1976 | Switzerland . | |

*Primary Examiner*—Joseph F. Peters, Jr.
*Assistant Examiner*—D. W. Underwood
*Attorney, Agent, or Firm*—Blanchard, Flynn, Thiel, Boutell & Tanis

[57] ABSTRACT

A braking blade for a ski brake adapted particularly for skiing in deep snow, which blade is arranged at the end of a braking arm of a ski brake, which braking arm consists preferably of a spring wire, and is held secured against a loss, wherein the blade, viewed in the width dimension, is divided by the braking arm into a smaller braking surface which is adjacent the ski and into a larger braking surface which is remote from the ski, which braking surfaces have, in the retracted position of the ski brake, a position which is approximately parallel with respect to the longitudinal axis of the ski and in the braking position of the ski brake are arranged substantially perpendicularly with respect to the longitudinal axis of the ski.

9 Claims, 11 Drawing Figures

BRAKING BLADE AND MOUNTING THEREFOR

FIELD OF THE INVENTION

This invention relates to a braking blade construction and a mounting therefor for use on a ski brake.

BACKGROUND OF THE INVENTION

Such a braking blade is described for example in Swiss Pat. No. 580,434 (compare in particular FIGS. 4 and 1) and in Austrian Pat. No. 339,794 which partially corresponds to said reference (compare FIGS. 4 and 1). The goal of the known solution lies in associating with the ski brake a braking surface, because the end regions of the individual braking arms, which regions consist exclusively of a spring wire, do not result in a sufficient braking action. To arrange this known braking blade at the end of the associated braking arm, the free end of the braking arm area which is bent back at 180° is first lightly bent outwardly, the blade is mounted above a hole which is provided off-center with respect to its width dimension, wherein a further wire section of the braking arm extends through an opening in the blade, and finally the braking arm end is bent inwardly. The braking arm end which holds the braking blade and the further wire section of the braking arm, which section extends through the opening of the braking blade, extend thereby substantially perpendicularly to one another. In this manner also the area of swing of the entire braking blade around the braking arm end, which acts as a pivot bearing for the braking blade, is determined.

This conventional construction has the disadvantage that a change of the braking blades having different width dimensions, which is necessary as needed, is not easily possible, because the braking arms are manufactured mostly of a spring wire of a 4–5 mm. diameter, which wire diameter cannot be bent outwardly and inwardly by hand in particular on the slope, which measure would be necessary for such a change. Even if the installation can take place without difficulties in the workshop and in particular during the first manufacture of the ski brake, a disassembly and repeated assembly is, however, associated at least with the usage of suitable tools.

A further disadvantage of the known construction consists in its function. It is written in the description that when the ski brake is swung from the braking position into the retracted position, namely during stepping in, the side of the braking blade closest the side of the ski and having the smaller braking surface hits against the lower edge of the ski, so that the braking blade assumes a position which extends approximately parallel with respect to the longitudinal axis of the ski, however, such a swing does not always exist, for example, especially when the braking blade is iced up, so that in such cases the ski brake can be swung only by an additional manipulation into the retracted position, which situation is complicated and awkward. One can also not exclude that the braking blade pivots in the retracted position of the ski brake about the braking arm half which serves as a bearing, for example during a fall of the skier, which causes the swinging of the ski brake from the retracted position into the braking position to be hindered. The released ski would in such a case slide freely nonstop and possibly cause an accident.

It is remarked on the side that the known construction permits a locking of the ski brake for the transport of same. Such a measure is no longer permissible today, because the ski brake must be moved always into a true retracted position by stepping in; in other words, in the case of a fall of the skier, the ski brake must swing automatically into the braking position, an activation of the ski brake from the transport position into the retracted position may not be left up to the will of the skier.

On the other hand, ski brakes are known in many various constructions, which are equipped with braking mandrels. Such braking mandrels are mostly plastic coverings, which enclose the end of a braking arm which consists generally of a spring-wire material. Such braking mandrels are best suited for downhill skiing on hard packed and prepared slopes, however, are less suited for stopping the skis in deep snow, powder snow, because in such cases the delay is less. Due to an insufficient delay, undesired accidents can happen, even if these are only isolated cases. Such accidents must be prevented even when their outcome—due to the after all existing delay—is connected with reduced injury.

The purpose of the invention is to provide a braking blade and mounting therefor of the above-mentioned type such that it can be used effectively without occurrence of the mentioned disadvantages in a ski brake, which has a braking arm of the above-mentioned type. The invention is to be used in particular in ski brakes, which have a braking mandrel consisting of a plastic covering on their braking arms, through which the ski brake can be used fully by the skier himself simply and without using any tools and also without damage to the entire construction of the ski brake both on prepared slopes and also in deep snow, powder snow.

The set purpose is inventively attained by the braking blade being movable, when needed, onto the end of the braking arm, which end is provided preferably with a braking mandrel, is arranged releasably lockable on same and can be removed from same arbitrarily without deformation of any structural parts.

Due to the fact that the braking blade is constructed as a separate member, it can be mounted, when needed, on an existing ski brake and can again be removed from same. A mounting and removal of the braking blade is not connected with any deformation of any structural part of the entire ski brake and/or the braking blade. The braking blade is locked releasably at the end area of the braking arm or at the braking mandrel, so that a loss is prevented and a disassembly thereof can be done only arbitrarily. The entire construction is thereby simple; the inventive braking blade can also be used in connection with existing ski brakes.

BRIEF DESCRIPTION OF THE DRAWINGS

Further details, characteristics and advantages of the invention will be apparent with reference to the drawings, which illustrate five exemplary embodiments, in which.

DETAILED DESCRIPTION

Figure 1:
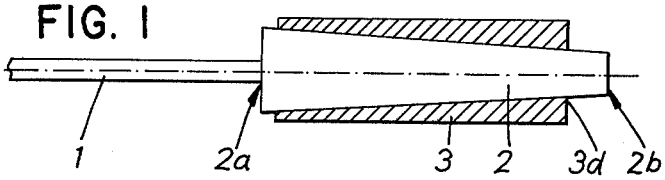
FIG. 1 is a partially sectioned side view of a braking mandrel embodying the inventive brake mounting for skiing in deep snow.
Figure 2:
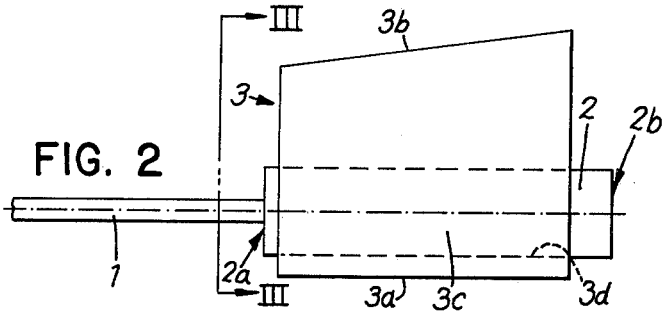
FIG. 2 is the top view of FIG. 1.
Figure 3:
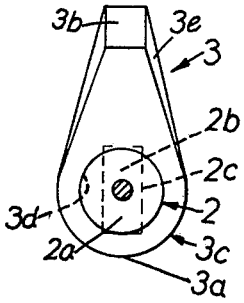
FIG. 3 is a sectional view taken along the line III—III of FIG. 2.

A braking mandrel 2 of a common type is provided with a round cross section at one end of a braking arm 1. In the embodiment of FIGS. 1 to 3, however, the braking mandrel 2 has at the end 2*a*, adjacent the braking arm 1, a round cross section, whereas the end 2*b* of the braking mandrel 2, which end is remote from the braking arm 1, has a rectangular cross section.

The outer surface of the braking mandrel 2 is transformed smoothly and continuously from the round cross sectioned shape (end 2*a*) into the rectangular cross sectioned shape (end 2*b*). The length of the longer side 2*c* of the rectangular cross sectioned end 2*b* corresponds approximately with the diameter of the end 2*a*.

The braking mandrel 2 is arranged in such a manner on the braking arm 1 that in the braking position the longer side edge 2*c* of the end 2*b* will lie substantially parallel with respect to the plane of the upper side of a ski (not illustrated).

A brake blade 3 is mounted on the braking mandrel 2 for use while skiing in deep snow. The brake blade 3 has in a top view thereof a shape closely approximating that of a parallelogram, in which one side (inner side 3*a*) facing, in the braking position thereof, a ski (not illustrated) is arranged perpendicular to the two parallel ends 2*a* and 2*b*. An outer side 3*b* which is arranged opposite the inner side 3*a* has a shape which rises continuously from the region of the end 2*a* toward the end 2*b* of the braking mandrel 2.

The part of the brake blade 3, which part is associated with the inner side 3*a*, has a cylindrical form 3*c*, the diameter of which is slightly larger than the diameter of the braking mandrel 2 in the region of the end 2*a*. The brake blade 3 has a recess 3*d* on the inside of the region of its cylindrical form 3*c*, which is substantially congruent with respect to the shape of the braking mandrel 2.

The brake blade 3 is designed slightly shorter than the length of the braking mandrel 2 and is moved onto the braking mandrel 2 so that the braking mandrel 2 projects farther beyond the blade in the region of the end 2*b* than in the region of the end 2*a*. The side surfaces 3*e* (FIG. 3) of the brake blade 3 are tapered continuously from the part 3*c* converging toward the outer side 3*b*. The width of the outer side 3*b* corresponds approximately with the width of the end 2*b* of the braking mandrel 2.

The assembly procedure to provide the braking mandrels 2 with the brake blade 3 is particularly simple. The brake blade 3 is moved into a position as it is illustrated in FIGS. 1, 2 and 3. Subsequently, the brake blade 3 is moved onto the braking mandrel 2 until it is fixedly jammed or forced fit thereon, namely, can only be manually released from said braking mandrel 2. The jammed or forced fit connection is caused by the special shape of the braking mandrel 2 and the recess 3*d* in the brake blade 3, which recess is designed congruently to said braking mandrel 2.

Figure 4:
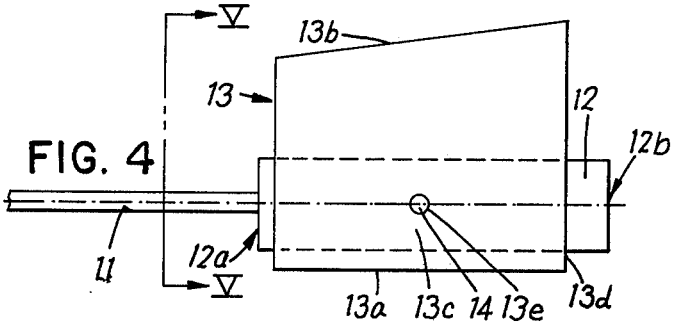
FIG. 4 is a top view of a different exemplary embodiment of a brake mounting.
Figure 5:
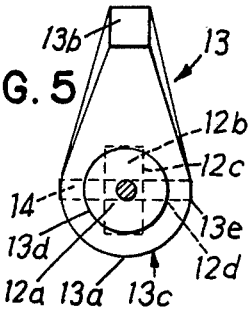
FIG. 5 is a sectional view taken along the line V—V of FIG. 4.

The exemplary embodiment according to FIGS. 4 and 5 differs from the one according to FIGS. 1 to 3 only in the brake blade 13 being secured against loss to the braking mandrel by a locking pin 14.

The locking pin 14 has a cylindrical cross section. Its length corresponds approximately with the diameter of the cylindrical form of the brake blade 13*c*. The locking pin 14 extends through an opening 12*d* in the braking mandrel 12 and an opening 13*e* in the brake blade 13. The locking pin 14 is positioned so that its axis is substantially parallel to the end surfaces 12*a* and 12*b* and perpendicular to the longer side edge 12*c* of the braking mandrel 12.

Figure 6:
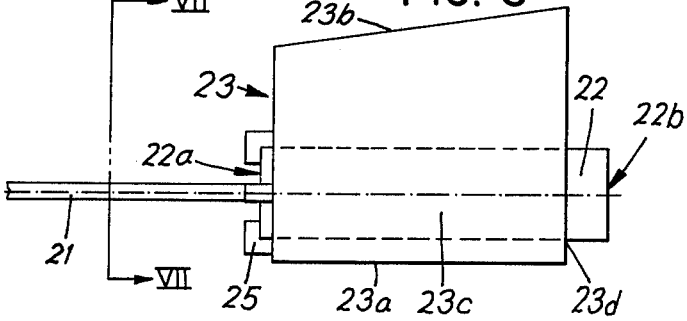
FIG. 6 is a top view of a further exemplary embodiment.
Figure 7:
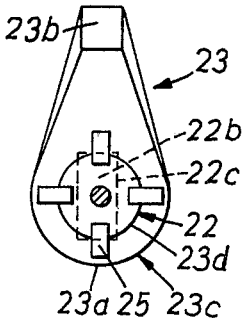
FIG. 7 is a sectional view taken along the line VII—VII of FIG. 6.

In a further exemplary embodiment according to FIGS. 6 and 7, L-shaped holding members 25 are provided on the brake blade 23. The holding members 25 are fixedly arranged on the part of the brake blade 23 which has the cylindrical form 23*c* and are positioned adjacent the end 22*a* of the braking mandrel. The holding members 25 which are each offset at 90° from each other extend beyond and one leg thereof grips over the end 22*a* of the braking mandrel 22 to thereby prevent an uncontrolled sliding off of the brake blade 23 from the braking mandrel 22. Each holding member 25 has an approximately square cross section and a 90° bend to form a small leg extending in a direction toward the longitudinal axis of the braking mandrel 2. The holding members 25 are made of an elastic material, which facilitates an assembly of the brake blade 23 to the braking mandrel 22 or removal therefrom.

The brake blade 23 with the inventive holding members 25 is moved just as in the case of the preceding two exemplary embodiments onto the braking mandrel 22 until the holding members 25 grip over same and prevent a loss of the brake blade 23. To disassemble the brake blade 23, the elastic holding members 25 are flexed apart until they release the end 22*a* of the braking mandrel 22 so that the brake blade 23 can be pulled off unhindered.

It is possible in all of the previously described exemplary embodiments to use the ski brake also without the inventive brake blades 3, 13, 23. The brake blades 3, 13, 23 are therefore only installed during skiing in deep snow.

Figure 8:
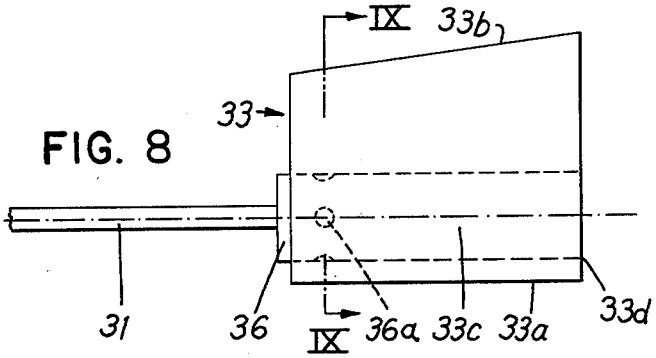
FIG. 8 illustrates an exemplary embodiment of a brake mounting in which same is indexically mounted at 90° spaced positions on a braking mandrel, and can be used in the corresponding position both in deep snow and also on a hardened slope.
Figure 9:
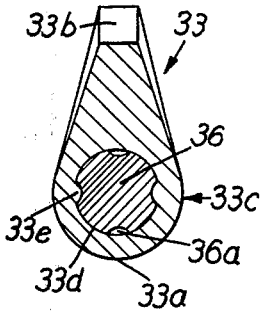
FIG. 9 is a cross-sectional view taken along the line IX—IX of FIG. 8.

A cylindrical mandrel 36 is provided on the braking arm 31 in the exemplary embodiment according to FIGS. 8 and 9. The mandrel 36 has, on the periphery thereof, in the region of the end facing the braking arm 31, four spherical-segmentlike recesses 36*a* which are each offset at 90° from each other.

A brake blade 33 has also in its cylindrically formed part 33*c* a central cylindrical opening 33*d* which is arranged concentrically with respect to the cylindrical mandrel 36. The remaining part of the brake blade 33 corresponds substantially with the exemplary embodiments which are illustrated in FIGS. 1 to 7. Furthermore, the cylindrical opening 33*d* has in the region of its end which is associated with the braking arm 31 two cams 33*e* which are offset at 180°. The shape of the two cams 33*e* is congruent with respect to the spherical-segmentlike recesses 36*a*. The brake blade 33 and its cams 33*e* are made of an elastic material. Thus, it is possible to move or to lock the brake blade 33 onto the cylindrical mandrel 36 and to pull same off in the same manner from the cylindrical mandrel 36.

During skiing in deep snow, the brake blade 33 is moved onto the cylindrical mandrel 36 so that same is positioned in the braking position with its greatest possible surface perpendicular to a ski (not illustrated) and thus carries out the best possible braking action in deep snow. During skiing on a hard slope, the brake blade 33 is indexed or swivelled at 90° on the cylindrical mandrel 36, such that in the braking position its part which has the cylindrical form 33*c* will face in direction toward the tip of the ski.

Figure 10:
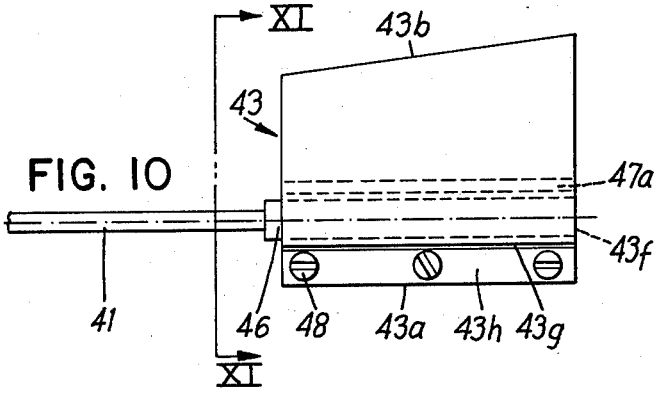
FIG. 10 illustrates a further exemplary embodiment of a brake mounting, which can be fixed in two different positions spaced at 90° to one another on the braking mandrel.
Figure 11:
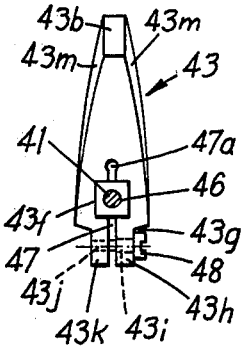
FIG. 11 is a sectional view taken along the line XI—XI of FIG. 10.

FIGS. 10 and 11 illustrate a brake blade 43, which can be used both in deep snow and also on a hard slope. A brake mandrel 46 having a square cross section is provided on one braking arm 41. The shape of this brake blade 43 corresponds in a cross-sectional view also with a parallelogram, in which one side is positioned at a right angle with respect to the two parallel sides. An outer side 43*b* is also positioned at an angle with respect to the braking arm 41. The inner side 43*a* of the brake blade 43 which is opposite the outer side 43*b* is divided in the longitudinal direction by a slot 47, the bottom wall of which terminates inside of the brake blade 43 in a cylindrical opening 47*a*. In the region where the brake blade 43 sits on the mandrel 46, the inner side 43*a* of the brake blade 43 has a congruent recess 43*f* of a square cross section, which recess corresponds in shape with the mandrel 46 and communicates with the slot 47. Each of the outer side surfaces 43*m* of the brake blade 43 have a transfer surface 43*g* into a flangelike part 43*h*, 43*k*. The two flangelike parts 43*h*, 43*k* have in their end regions and approximately in their center an aligned opening 43*i*, 43*j*, wherein one of the openings 43*j* is constructed as an internally threaded opening and the other opening 43*i* only as an opening with a smooth internal wall surface. With the help of screws 48, it is possible to move the flangelike parts 43*h*, 43*k* toward each other to enclose the mandrel 46 and thus can be clamped on or with the mandrel 46. Thus, a loss of the brake blade 43 is positively prevented.

As in the preceding exemplary embodiment according to FIGS. 8 and 9, the brake blade 43 according to FIGS. 10 and 11 can also be used both during skiing in deep snow and also during skiing on hard-packed slopes. It is possible to clamp the brake blade 43, indexed or swivelled at 90°, on the mandrel 46. In the two last-mentioned exemplary embodiments according to FIGS. 8 to 11, the brake blades 33 and 43 terminate flush with the ends of the cylindrical mandrel 36 or the square mandrel 46 which do not face the braking arms 31 or 41. This means that the mandrels 46 do not project at these ends beyond the blades 33, 43.

The invention is not to be limited to the illustrated exemplary embodiments. Various modifications are possible which lie by all means within the scope of the invention. For example, the shape of the brake blades could be different. It is also possible for the individual braking mandrels to be formed by the free ends of the braking arms themselves and, for skiing in deep snow, the brake blades can be fastened without interpositioning of a mandrel directly on the associated braking arm.

The embodiments of the invention in which an exclusive property or privilege is claimed are defined as follows:

1. A blade for a ski brake pivotally mounted on a ski, comprising:

an elongated brake arm having an enlarged and elongated mandrel on a terminal end thereof, said mandrel having an external first surface thereon;

an elongated brake blade having means defining a hole therethrough and extending in the longitudinal direction and along one lateral side thereof, said hole having an interior second surface matching said first surface on said mandrel and being adapted to receive said enlarged and elongated mandrel therein, the length of said brake blade being shorter than the length of said mandrel, said brake blade having a large exterior third surface extending laterally from said one side and facing in a direction generally perpendicular to the longitudinal axis of said arm; and connecting means for releasably connecting said brake blade to said enlarged and elongated mandrel so that said first and second surfaces are operatively engaged with each other, said mandrel extending outwardly beyond both ends of said hole in said brake blade.

2. The blade according to claim 1, wherein said mandrel has, at its end adjacent said brake arm, a round cross section and at the end which is remote from said brake arm a rectangular cross section, and wherein the transition from the form with said round cross section into the form with said rectangular cross section is continuous and smooth.

3. The blade according to claim 2, wherein said brake blade has, in a longitudinal cross section thereof, a form having two parallel end surfaces, an inner side extending perpendicular to said end surfaces and an outer side extending at an angle to said end surfaces, and wherein said outer side which is arranged opposite said inner side has a shape which continuously rises from the region of said mandrel with said round cross section to the end with said rectangular cross section.

4. The blade according to claim 1, wherein said connecting means is a locking pin having a symmetrical cross section and is arranged substantially perpendicularly with respect to the longitudinal axis of said arm and generally centrally with respect to said mandrel, and wherein said locking pin extends through said mandrel in an opening provided therethrough and an opening through said brake blade.

5. The blade according to claim 1, wherein on the side of said brake blade, which side faces said brake arm, there are provided at least two angled holding members of an elastically flexible material, said holding members being arranged offset from one another at the same angle, and wherein each of said holding members has a 90° bend therein which hooks over the end of said mandrel facing said braking arm.

6. The blade according to claim 1, wherein said mandrel is cylindrical and has, in the region of the end facing said brake arm and on the periphery thereof, at least two recesses which are offset from one another at the same angle and are spherical-segmentlike, and wherein two cams are provided on said brake blade, said cams being offset corresponding to the offset of said recesses and have a shape which corresponds to said spherical-segmentlike recesses and are releasably engaged with and disengaged from each of said recesses.

7. The blade according to claim 6, wherein each cam consists of a deformable elastic material.

8. The blade according to claim 1, wherein said mandrel has a square cross section, and wherein said brake blade has a slot in its longitudinally extending side thereby defining two flanges, each of said flanges having openings therein which are axially aligned, wherein each axially aligned set of openings receives screw therein for facilitating a drawing together of said flanges, and wherein said brake blade is clampingly secured to said mandrel in response to said screw drawing said flanges together.

9. The blade according to claim 8, wherein each of said flanges has a tapered surface transferring into said exterior surface of said brake blade.

* * * * *